United States Patent [19]

Kis

[11] Patent Number: 4,856,152

[45] Date of Patent: Aug. 15, 1989

[54] APPARATUS FOR NEEDLING A NONWOVEN WEB

[75] Inventor: Ludwig Kis, Goldwörth, Fed. Rep. of Germany

[73] Assignee: Textilmaschinenfabrik Dr. Ernst Fehrer Aktiengesellschaft, Linz, Austria

[21] Appl. No.: 216,313

[22] Filed: Jul. 8, 1988

[30] Foreign Application Priority Data

Jul. 23, 1987 [AT] Austria ..... 1861/87

[51] Int. Cl.[4] ..... D04H 18/00

[52] U.S. Cl. ..... 28/114; 28/109

[58] Field of Search ..... 28/107, 113, 114, 115, 28/109

[56] References Cited

U.S. PATENT DOCUMENTS 232,962 10/1880 Harrington ..... 28/115 X 3,208,125 9/1965 Hall et al. ..... 28/114 X 3,372,447 3/1968 Williams et al. ..... 28/113

3,890,681 6/1975 Fekete et al. ..... 28/107

FOREIGN PATENT DOCUMENTS 60-239554 11/1985 Japan ..... 28/107

825726 4/1981 U.S.S.R. ..... 28/107

*Primary Examiner*—Robert R. Mackey

*Attorney, Agent, or Firm*—Kurt Kelman

[57] ABSTRACT

An apparatus for needling a nonwoven web comprises a needle carrier, which is adapted to be driven, and a bedplate and a stripper for guiding the web between them. In order to impart a pure rotary motion to the needle carrier, the needle carrier consists of a roller and is adapted to rotate about its own axis and to revolve in the opposite sense about an axis of revolution which is parallel to the axis of the roller so that each needle describes a hypocycloidal path.

6 Claims, 4 Drawing Sheets

APPARATUS FOR NEEDLING A NONWOVEN WEB

BACKGROUND OF THE INVENTION

1. Field of the Invention

This invention relates to an apparatus for needling a nonwoven web, comprising a drivable needle carrier, a bedplate and a stripper, which have passage holes for the needles carried by the needle carrier, wherein said bed plate and said stripper define between them a gap for receiving the web to be needled.

2. Description of the Prior Art

Conventional apparatuses for needling a nonwoven web comprise at least one needle board, which is movable up and down and carries needles for penetrating the web, which is guided between a bedplate and a stripper and moves transversely to the direction of penetration. In those known needling apparatuses the needle board moving up and down and its drive give rise to undesired vibration and means for suppressing said vibration to a tolerable degree involve a high expenditure. Rotary needle-carrying rollers can be driven by means which are simpler in structure than the drive for a needle board which is moving up and down and permit a perfect mass balancing. On the other hand, the use of rotary needle rollers for a needling of nonwoven webs is opposed by the requirement for a high penetration density because this cannot be achieved unless the surface speed of the needle roller greatly exceeds the speed of travel of the web.

SUMMARY OF THE INVENTION

For this reason, it is an object of the invention to provide a needling apparatus which is of the kind described first hereinbefore and affords the advantages of rotary needle rollers but avoids the disadvantage involved in the use of such rollers.

That object is accomplished in accordance with the invention in that the needle carrier consists of a roller and for a movement of each needle along a hypocycloidal path is adapted to be driven to rotate about the axis of the roller in one sense and to revolve in the opposite sense about an axis of revolution, which is parallel to the axis of the roller, and the stripper comprises at least a segment of a cylinder which is centered on said axis of revolution.

The rotation of the needle roller about the axis of the roller and its revolution about an axis of revolution, which is parallel to the axis of the roller, have the result that the needle points describe hypocycloidal paths and limited local penetration areas adjacent to the stripper will be obtained for respective needles if the diameters of the stationary circle which determines the hypocycloid and of the rolling circle which rolls in said stationary circle are so selected that the needles will pierce the web in defined local areas adjacent to the stripper. As a result, a stationary stripper can be used, which has the shape of at least a segment of a cylinder, which is centered on the axis of revolution, and the speed of travel of the web along the web path between the bedplate and the stripper may be selected independently of the peripheral velocity of the needle roller. Because the needle roller performs also a revolution about the axis of revolution, a perfect mass balance can be ensured by the provision of a co-revolving balancing mass so that the problems caused by the vibrations which will be generated if reciprocating needle boards are used will be avoided. Because each needle point moves along a hypocycloidal path, the needles may have a component of movement in the direction of travel of the web in the area which is pierced by the needles. This fact constitutes a further advantage which is aforded by the apparatus in accordance provided with needle boards which move up and down because the stretching of the web in its direction of travel is decreased.

A particularly simple design will be obtained if the stripper consists of a closed cylinder, which surrounds the needle carrier and is adapted to support the balancing masses which revolve about the axis of revolution. Besides, the flexural rigidity of the stripper will be increased so that larger working widths and stronger needling forces are permissible.

As has been stated hereinbefore, the diameter of the stationary circle which defines the hypocycloidal paths for the needles and the diameter of the rolling circle which rolls in said stationary circle should be matched in such a manner that the needles of the needle roller move through the holes of the stripper in the local area which is defined by said holes and pierce the web during each revolution of the said rolling circle. If certain ratios of said diameters are selected, the needles will describe such closed hypocycloidal paths that only predetermined arcuate sections of the periphery of the needle roller will pierce the web so that it will be sufficient to provide the needle roller with needles in said arcuate sections. In that case, particularly desirable operating conditions and designs will be ensured if the distance from the axis of the roller to the axis of revolution is equal to the product obtained by the multiplication of one-half of the radius of the rolling circle with an odd number, preferably with one, and the needle carrier carries the needles on its periphery intwo diametrically opposite arcuate sections, which are used in alternation. Owing to the fact, the two arcuate sections of the needle carrier may differ in needle pitch so that the web can be needled with different needle pitches at the same time and the stripper and optionally also the bedplate will permit needles having both pitches to pass therethrough. This will be the case if the ratio of the two needle pitches is an even number.

To permit an adjustment of the depth of penetration it will be desirable to pivot the bedplate on an axis which is parallel to the axis of revolution. In that case, a pivotal adjustment of the bedplate relative to the stripper will change the gap between the stripper and the bedplate so that the depth of penetration will be changed too. Because it is desired to provide for the travel of the web, a gap which tapers toward its exit end, the bedplate, which at least approximately conforms to the curvature of the stripper, is desirably pivoted approximately at the center of the area in which the web is pierced.

DETAILED DESCRIPTION OF THE PREFERRED EMBODIMENTS

Figure 1:
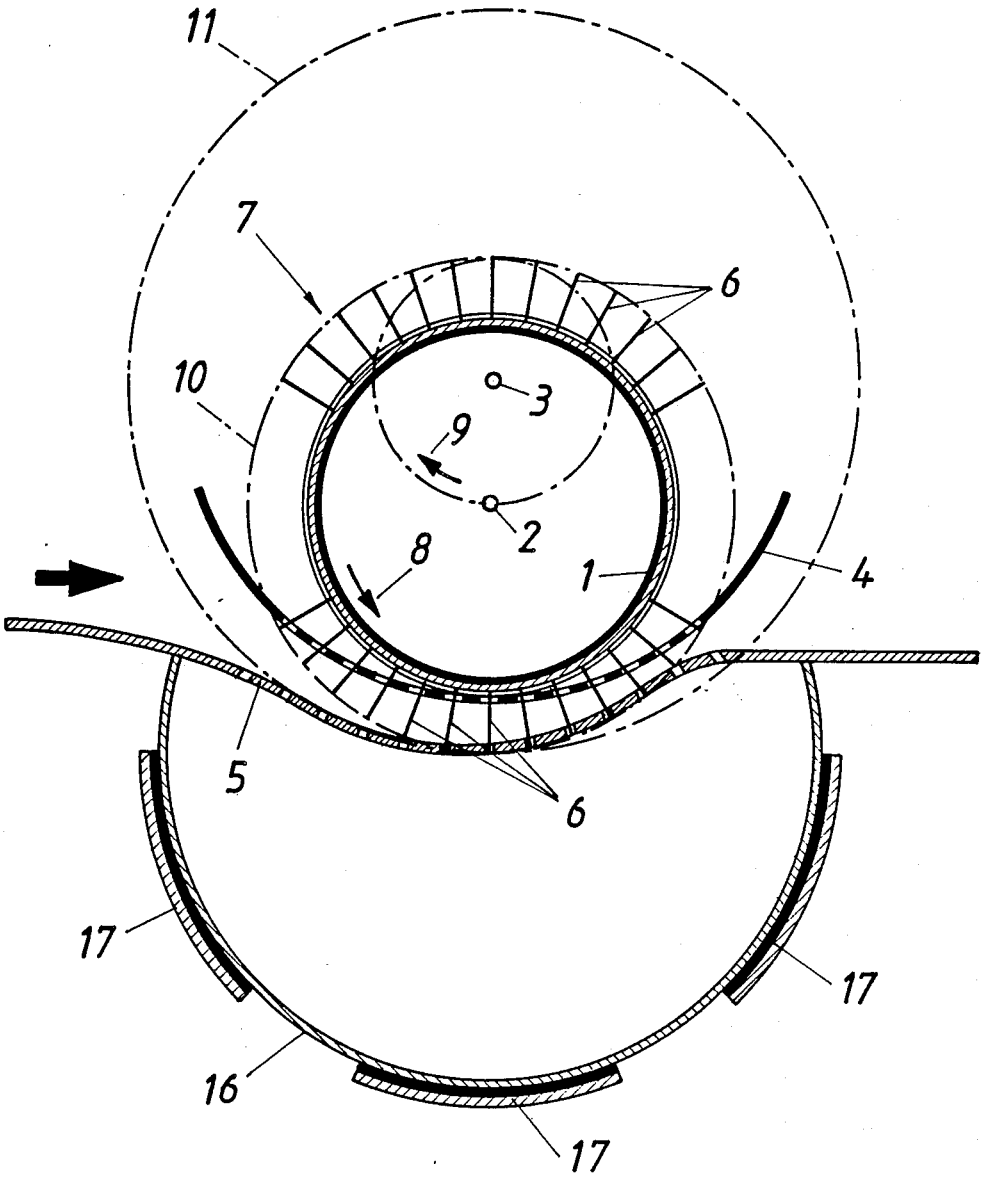
FIG. 1 is a diagrammatic axial sectional view showing an apparatus in accordance with the invention for needling nonwoven webs.

Illustrative embodiments of the invention are illustrated on the drawing.

FIG. 1 shows an apparatus for needling a nonwoven web. The apparatus comprises a needle carrier, which comprises a roller body 1 and is adapted to rotate about its own axis 2 and to revolve about an axis of revolution 3, which is parallel to the axis of the roller. The apparatus also comprises a gap, in which the nonwoven web is guided between a stripper 4, which is centered on the axis of revolution 3, and a bedplate 5, which substantially conforms to the curvature of the stripper 4.

Figure 3:
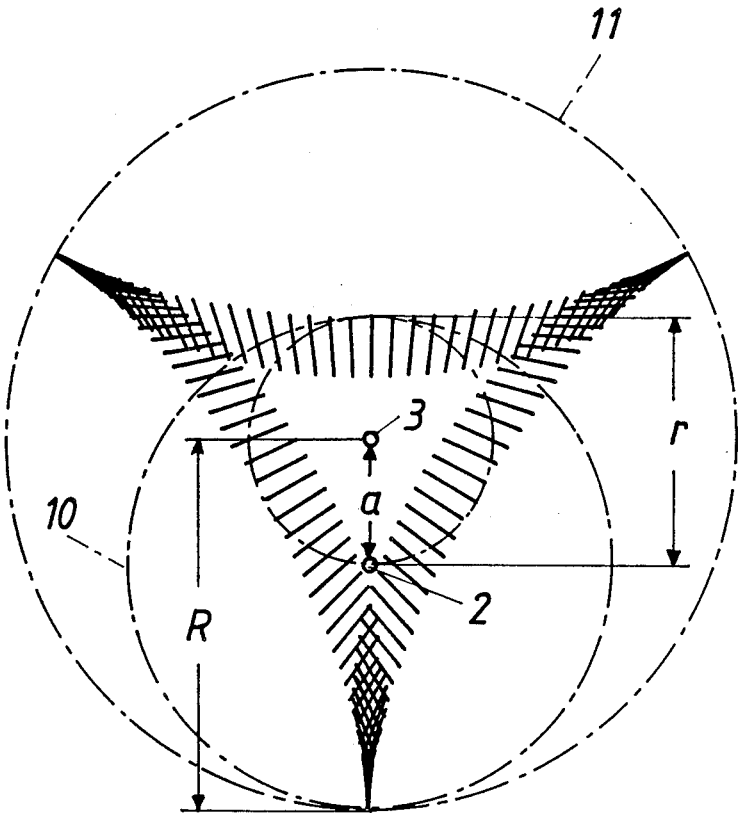
FIG. 3 shows the hypocycloidal path which will be described by each needle if the diameter of the rolling circle equals the diameter of the needle roller and the radius of the stationary circle is three times one-half of the radius of the rolling circle.

Because the needle carrier 7 consisting of a roller body 1 and needles 6 rotates about the axis 2 of the roller and at the same time revolves about the axis of revolution 3, in the senses indicated by the arrows 8 and 9, respectively, a geometric rolling circle 10 will be generated, which extends around the axis 2 of the roller and rolls in an imaginary stationary circle 11. As a result, each needle 6 will describe a hypocycloidal path, such as is shown in FIG. 3, which illustrates the various positions which are assumed by a needle during a revolution of the needle roller 7 if the outside diameter of the needle roller 7 is equal to the diameter of the rolling circle 10 and the distance a between the axis 2 of the roller and the axis of revolution 3 equals one-half of the radius r of the rolling circle 10. In that case, the radius R of the stationary circle 11 will be 1.5 times the radius r of the rolling circle 10. With those dimensional relations, each needle path has the configuration of a closed hypocycloid of the illustrated kind so that the needles can move in and out through the holes in the stripper 4 and in the bedplate 5. As the needles pierce the web, they have a component of motion in the peripheral direction of the stationary circle 11, i.e., in the direction of travel, so that the stretching of the web in the direction of travel is decreased.

Figure 4:
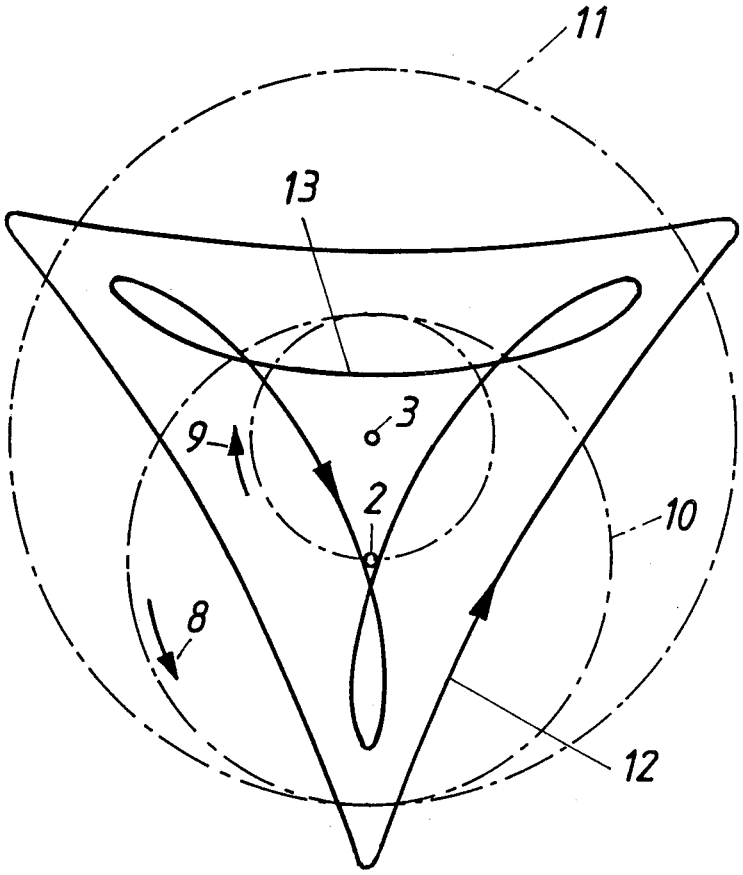
FIG. 4 shows the paths described by the point of a needle if the ratio of the diameters of the stationary circle and of the rolling circle isthe same as in FIG. 3 but the needle roller is larger in outside diameter in one case and smaller in another case.

If the relations shown in FIG. 3 are changed only in that the outside diameter of the needle roller 7 is increased, the point of each needle will describe a hypocycloidal path such as is represented by the curve 12 in FIG. 4. From that showing, it is directly apparent that the needles have a larger component in the direction of travel as they pierce the web. If the diameter of the needle rolelr 7 is smaller than in FIG. 3, the point of each needle will describe the hypocycloid 13 shown in FIG. 4. In such an embodiment, the needles 6 will have a component of motion which is transverse to the direction of penetration but in the opposite direction so that a reversal of the direction of travel of the web is advisable.

Figure 2:
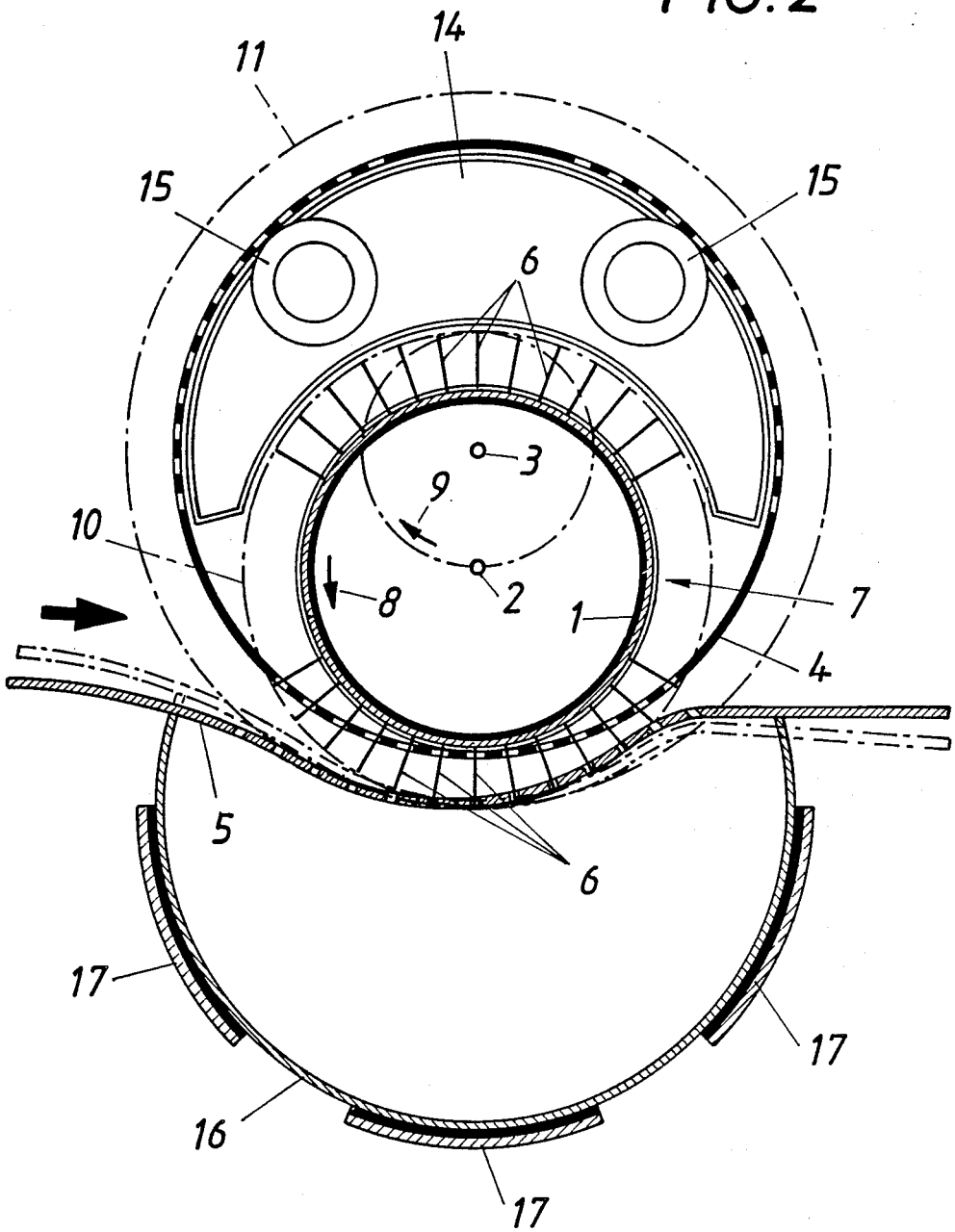
FIG. 2 is a view that is similar to FIG. 1 and shows a modified design.

From FIGS. 1, 3 and 4, it is directly apparent that the speed of travel of the web to be needled can be selected independently of the peripheral velocity of the needle roller 7 because the conditions relating to the penetration of the needles are similar to those obtained with needle boards moving up and down. The piercing movement is much faster than the speed of travel. But different from such needle boards moving up and down, the needle roller 7 can be actuated by a simpler drive and with a perfect mass balance. As is apparent from FIG. 2, balancing masses 14 may be provided, which together with the needle roller 7 revolve about the axis of revolution 3 so that the desired mass balance is achieved in a simple manner.

If the stripper 4 consists of a closed cylinder, the balancing masses 14 may be supported by rollers 15 directly on the stripper 4. It will be understood that in such case the cylindrical stripper 4 should be provided with holes as passages for the needles 6 of the needle roller 7 not only in the piercing range but also in a section which has rotational symmetry to the piercing range so that the rotation of the needle roller 7 about its own axis 2 and the revolution of the needle roller 7 about the axis of revolution 3 will not be obstructed. Owing to the geometrical relations which have been selected, it will be sufficient to provide the needle roller 7 with needles 6 on two diametrically opposite arcuate sections of its periphery because the needles move along closed paths and only needles disposed in defined local sections of the needle roller will move through the cylindrical stripper 4.

For an adjustment of the depth of penetration, the bedplate 5 is adjustable about a pivotal axis that is parallel to the axis of revolution 3. For that purpose, the bedplate 5 is mounted on a circular cylindrical bearing body 16, which is mounted for a pivotal adjustment in arcuate sliding surface bearing segments 17. With that arrangement, the gap between the stripper 4 and the bedplate 5 can be changed as is illustrated in phantom in FIG. 2. The change of the width of the gap in which the web is guided between the stripper 4 and the bedplate 5 will automatically result in a change of the depth of penetration.

I claim:

1. In an apparatus for needling a nonwoven web, comprising web-guiding means comprising a bedplate and a stripper, which defines with said bedplate a gap in which said web is adapted to travel, said bedplate and said stripper being provided with a multiplicity of holes, and a needle carrier, which carries needles and is adapted to be driven to move said needles through said holes into and out of said gap, the improvement comprising that said needle carrier consists of a needle roller and is adapted to be driven to rotate about the axis of said roller in a first sense and to revolve in an opposite, second sense about an axis of revolution, which is parallel to the axis of said roller so that a rolling circle rolling in a stationary circle is generated and each of said needles describes a hypocycloidal path, and said stripper consists of at least a segment of a cylinder which is centered on said axis of revolution.

2. The improvement set forth in claim 1, wherein said stripper consists of a cylinder which surrounds said needle carrier.

3. The improvement set forth in claim 1, wherein the distance from the axis of said roller to said axis of revolution equals the product of one-half of the radius of said rolling circle times an odd number, and said needle carrier carries said needles only in two diametrically opposite sections of the periphery thereof.

4. The improvement set forth in claim 3, wherein said distance equals one-half of said radius of said rolling circle.

5. The improvement set forth in claim 3, wherein said two peripheral sections of said needle carrier differ in needle pitch.

6. The improvement set forth in claim 1, wherein said bedplate is mounted to be pivotally adjustable about an axis which is parallel to said axis of revolution.

* * * * *